US008677924B1

(12) United States Patent
Brown et al.

(10) Patent No.: US 8,677,924 B1
(45) Date of Patent: Mar. 25, 2014

(54) SCOREKEEPER BOARD

(76) Inventors: Willie L. Brown, Montgomery, AL (US); Sabrina T. Singleton, Montgomery, AL (US)

( * ) Notice: Subject to any disclaimer, the term of this patent is extended or adjusted under 35 U.S.C. 154(b) by 357 days.

(21) Appl. No.: 13/068,093

(22) Filed: May 3, 2011

(51) Int. Cl.
*A63B 71/06* (2006.01)

(52) U.S. Cl.
USPC ..... 116/325; 235/90

(58) Field of Classification Search
USPC ..... 116/325, 326, 222; 40/657; 235/1 B, 90; 237/148 R, DIG. 26; D10/46.1; D21/342, 343, 344, 345, 346; 273/148 R, DIG. 26
See application file for complete search history.

(56) References Cited

U.S. PATENT DOCUMENTS

| | | | | | |
|---|---|---|---|---|---|
| 213,045 | A | * | 3/1879 | Greenspecht | 273/148 R |
| 219,280 | A | * | 9/1879 | LeCount | 273/148 A |
| 375,558 | A | * | 12/1887 | Massa | 235/90 |
| 800,812 | A | * | 10/1905 | Matson | 235/90 |
| 1,039,485 | A | * | 9/1912 | Biggar | 235/90 |
| 1,145,211 | A | * | 7/1915 | Pine | 235/124 |
| 2,477,825 | A | | 8/1949 | Richardson | |
| D164,766 | S | * | 10/1951 | Durgin | D10/46.1 |
| D169,801 | S | * | 6/1953 | Capodanno | D10/46.1 |
| 3,072,407 | A | | 1/1963 | Olson | |
| 3,695,512 | A | * | 10/1972 | Trudel | 235/90 |
| D238,957 | S | * | 2/1976 | Johnson | D10/46.1 |
| 5,090,106 | A | * | 2/1992 | Fink | 29/525 |
| D339,754 | S | | 9/1993 | Cranmer | |
| 5,491,324 | A | | 2/1996 | Vanderpool | |
| 5,791,652 | A | * | 8/1998 | Nielsen | 273/305 |
| 5,979,752 | A | * | 11/1999 | Holloway | 235/90 |
| 7,014,191 | B2 | | 3/2006 | Nasco | |
| D596,961 | S | * | 7/2009 | Moran et al. | D10/46.1 |
| D622,620 | S | * | 8/2010 | Cloonan | D10/46.1 |
| 2010/0050926 | A1 | | 3/2010 | Volack et al. | |

* cited by examiner

*Primary Examiner* — Richard A Smith
(74) *Attorney, Agent, or Firm* — George L Williamson

(57) ABSTRACT

Method and apparatus for a scoreboard for keeping score of a game of, for example, dominoes among multiple players. It comprises a generally rectangular shaped body having an upper surface and a lower surface, a left side and a right side and upper and lower ends. The upper surface has four sets of first apertures arranged in columns and numbered rows for receiving pegs for storage therein. An upper row of second apertures is provided above the first apertures for temporary placement therein of the pegs prior to the player having accumulated any points. The top surface discloses on the left side a series of scores running from 5 to 150 wherein the first player to reach 150 is the winner of the game. The top surface discloses a series of peg holes arranged in columns so that each player can have a dedicated series of peg holes.

8 Claims, 2 Drawing Sheets

SCOREKEEPER BOARD

BACKGROUND OF THE INVENTION

1. Field of the Invention

The present invention relates generally to scoreboards and, more particularly, is concerned with a scoreboard for keeping score during a game of dominoes among multiple players.

2. Description of the Related Art

Scoreboards have been described in the related art, however, none of the related art devices disclose the unique features of the present invention.

In U.S. Pat. No. D339,754 dated Sep. 28, 1983 Cranmer described a domino scoreboard. In U.S. Patent Application Publication 2010/0050926 dated Mar. 4, 2010 Volack, et al., disclosed a horseshoe scoreboard. In U.S. Pat. No. 2,477,825 dated Aug. 2, 1949, Richardson disclosed a peg scoreboard. In U.S. Pat. No. 5,491,324 dated Feb. 13, 1996, Venderpool disclosed a score-keeping-with-carry scoreboards. In U.S. Pat. No. 7,014,191 dated Mar. 21, 2006, Nasco disclosed a multi-player card game and method of playing the same. In U.S. Pat. No. 3,072,407 dated Jan. 8, 1963, Olson disclosed a game apparatus.

While these scoreboards may be suitable for the purposes for which they were designed, they would not be as suitable for the purposes of the present invention as hereinafter described.

SUMMARY OF THE PRESENT INVENTION

The present invention discloses a scoreboard for keeping score of a game of dominoes among multiple players. It comprises a generally rectangular shaped body having an upper surface and a lower surface, a left side and a right side and upper and lower ends. The upper surface has four sets of first apertures arranged in columns and numbered rows for receiving pegs for storage therein. An upper row of second apertures is provided above the first apertures for temporary placement therein of the pegs prior to the player having accumulated any points. The top surface discloses on the left side a series of scores running from 5 to 150 wherein the first player to reach 150 is the winner of the game. The top surface discloses a series of peg holes arranged in columns so that each player can have a dedicated series of peg holes. The top end of the body contains a storage compartment having a cover with a handle thereon so that the pegs can be stored in the storage compartment in a series of dedicated third apertures when the game is not being played. The top surface has colored columns wherein from left to right the colors are white, red, blue and green; however colors could be user-selected as he/she desired.

An object of the present invention is to provide a simple scoreboard for keeping score in a game of dominoes. A further object of the present invention is to provide a system for keeping the score which is accurate and dependable. A further object of the present invention is to provide a scoreboard which can be easily moved about and which is portable. A further object of the present invention is to provide a scoreboard for dominoes which is relatively easy to use. A further object of the present invention is to provide a scoreboard for dominoes which can be relatively inexpensively and easily manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figures 1, 2:
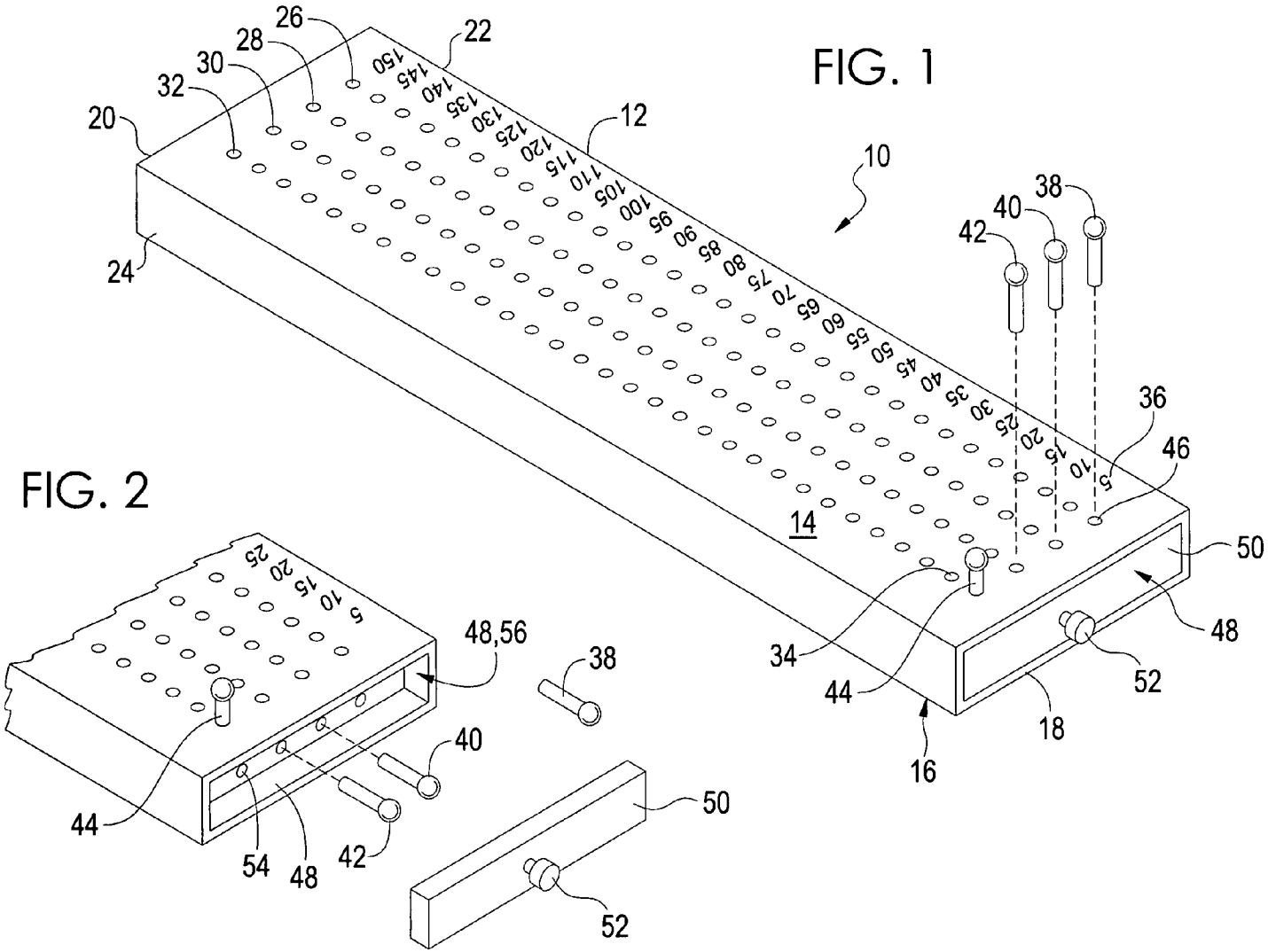
FIG. 1 is a perspective view of the present invention.
FIG. 2 is a partial perspective view of the present invention.

With regard to reference numerals used, the following numbering is used throughout the drawings.

10 present invention
12 body
14 upper surface
16 lower surface
18 upper end
20 lower end
22 left side
24 right side
26 column
28 column
30 column
32 column
34 first apertures
36 number
38 peg
40 peg
42 peg
44 peg
46 second apertures
48 compartment
50 cover
52 handle
54 third apertures
56 cavity

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 4 illustrate the present invention wherein a scoreboard for a game of dominoes is disclosed.

Figure 3:
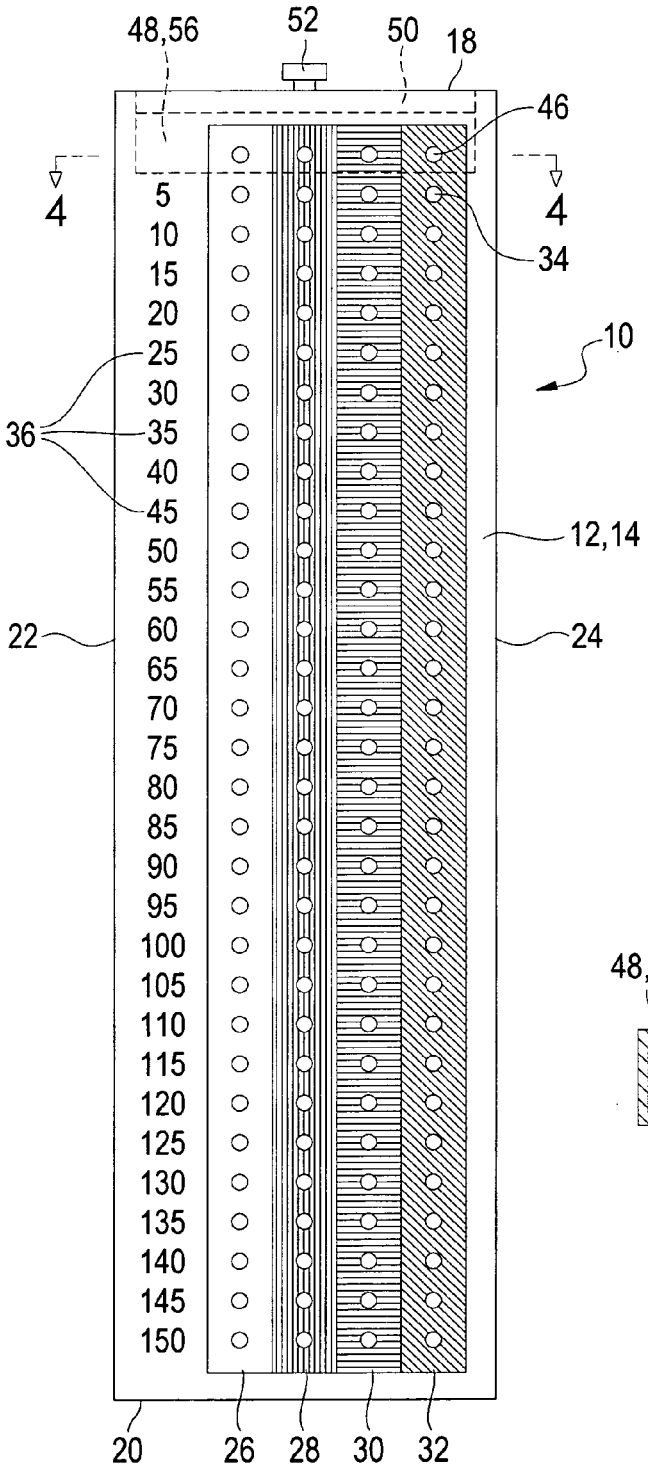
FIG. 3 is a plan view of the present invention.
Figure 4:
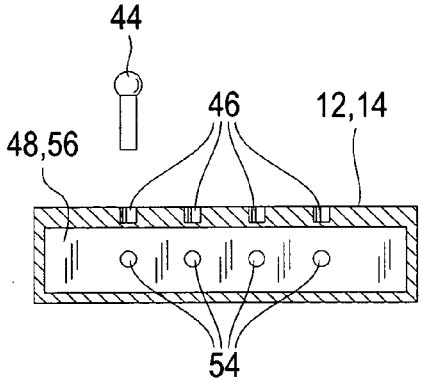
FIG. 4 is a cross sectional view taken from FIG. 3 as indicated.

Turning to FIGS. 1-4, therein is shown the present invention 10 being a scoreboard having a body 12 having an upper surface 14 and a lower surface 16, an upper end 18 and a lower end 20 along with a left side 22 and a right side 24. Shown on the upper surface 4 are four columns 26-32 of first apertures 34 aligned so that each row has on its left side numbers 36 using indicia ranging from 5 (five) to 150 (one hundred fifty) so that each of four players can have a dedicated column of apertures within which to place his/her pegs 38-44. Shown are columns 26 through 32 from left to right and the pegs are numbered 38 to 44 from left to right. Also shown at the upper end of the columns 26-32 are a row of second apertures 46 wherein the pegs 38-44 are placed at the start of the game which would correspond to a player having zero points. At the upper end of the scoreboard body 12 is a storage compartment 48 which is in a hollowed-out upper end or cavity 56 of the scoreboard having a cover 50 thereon with a handle 52 thereon containing an additional set of third apertures 54 for placement therein of the pegs 38 to 44 when a game is not being played and the pegs are being stored away for safe keeping. The pegs 38-44 are stored so that the longitudinal axis of the pegs are in the horizontal plane (parallel to the longitudinal axis of the scoreboard body 12) so that the thickness of the scoreboard can be minimized. By way of example, FIG. 3 shows the columns wherein column 26 is white, column 28 is red, column 30 is blue, and column 32 is green; however, the user could select any colors that he desired.

It can be seen that the present invention 10 is a simple scoring system for the game of dominoes. The present invention 10 will keep the score for each player from one through 4 to determine which one wins the game; i.e., accumulates 150 points first. Each peg 38-44 represent a player wherein there are one to four players. Each peg has a dedicated 30-hole count of five points each in columns which would total 150 points when the holes are arranged in columns which are identified by color. The first player to reach 150 points is the winner of the game. The scoreboard body 12 of the present invention 10 may be made of wood, plexiglass, plastic or the like and is expected to be substantially rectangular and having a length of about 8½ inches, a width of about 2½ inches, and a depth of about ½ inch. Each of the pegs 38-44 are about 1 inch long by about ⅛ inch in diameter. Each of the apertures is expected to be approximately ⅛ inch in diameter so as to complimentarily sized and shaped to receive the pegs 38-44. It is expected that the compartment 48 will be sized to store the four pegs in generally a horizontal plane so that the longitudinal axis of the pegs is parallel to the longitudinal axis of the scoreboard body 12 to minimize the size or thickness of the scoreboard and thereby minimize the materials used in the construction of the scoreboard body 12 and thereby the cost of manufacturing the scoreboard.

What is claimed to be new and desired to be protected by Letters Patent is set forth in the appended claims:

1. A scoreboard, comprising:

a) a body being substantially rectangular shaped having outer walls with upper and lower surfaces, upper and lower ends and left and right sides;

b) a plurality of first apertures arranged in a plurality of columns on said upper surface of said body, said first apertures spaced apart between said upper and lower ends, said columns spaced apart between said left and right sides;

c) wherein said first apertures are arranged in rows being marked with indicia from five to one hundred fifty;

d) a plurality of pegs for placement in said first apertures, wherein one said peg is assigned to each player, wherein a different one of said columns is assigned to each player, wherein each player can move his assigned peg from one said first aperture to a second said first aperture as said player accumulates points, wherein said player places his peg in the said first aperture corresponding to the points accumulated by said player;

e) a row of second apertures disposed on said upper surface of said body between said upper most first apertures and said upper end of said body for placement therein of said pegs while each player has zero points, wherein said row of second apertures corresponds to said columns of said first apertures;

f) a storage compartment disposed in one end of said body for placement therein of said pegs when the game is not being played, said storage compartment comprising a cavity having a wall at a bottom thereof, said cavity surrounded on four sides by all outer walls of said body and uncovered on said one end, third apertures in said wall for storage of said pegs, and a removable cover inserted into said recess, said cover being flush with edges of said outer walls forming sides of said recess and fully enclosing said recess and any pegs stored within; and g) a handle on said cover for facilitating removal of said cover into said recess.

2. The scoreboard of claim 1, in which each peg comprises an extended body with an enlarged head at one end thereof, whereby said pegs when stored in said cavity having said enlarged heads extending out of said third apertures.

3. The scoreboard of claim 2, in which each third aperture is aligned with one of said columns.

4. The scoreboard of claim 1, wherein each said column is uniquely colored so that each said player can visually identify his assigned said column.

5. A method of making a scoreboard, comprising the steps of:

a) providing a body being substantially rectangular shaped having outer walls with upper and lower surfaces, upper and lower ends and left and right sides;

b) providing a plurality of first apertures arranged in a plurality of columns on the upper surface of the body, the first apertures spaced apart between the upper and lower ends, the columns spaced apart between the left and right sides;

c) wherein the first apertures are arranged in rows being marked with indicia from five to one hundred fifty;

d) providing a plurality of pegs for placement in the first apertures, wherein a peg is assigned to each player, wherein a different one of said columns is assigned to each player, wherein each player can move his assigned peg from one said first aperture to a second said first aperture as the player accumulates points, wherein the player places his peg in the first aperture corresponding to the points accumulated by the player;

e) providing a row of second apertures on the upper surface of the body between the upper most first apertures and the upper end of the body for placement therein of the pegs while each player has zero points, wherein the row of second apertures corresponds to the columns of first apertures;

f) providing a storage compartment disposed in one end of the body for placement therein of the pegs when the game is not being played, said storage compartment comprising a cavity having a wall at a bottom thereof, said cavity surrounded on four sides by all outer walls of said body and uncovered on said one end, third apertures in said wall for storage of said pegs, and a removable cover inserted into said recess, said cover being flush with edges of said outer walls forming sides of said recess and fully enclosing said recess and any pegs stored within; and g) providing a handle on said cover for facilitating removal of said cover into said recess.

6. The method of claim 5, in which each said peg comprises an extended body with an enlarged head at one end thereof, whereby said pegs when stored in said cavity having said enlarged heads extending out of said third apertures.

7. The method of claim 6, in which each third aperture is aligned with one of said columns.

8. The method of claim 5, wherein each column is uniquely colored so that each player can visually identify his assigned column.

* * * * *